US005085530A

United States Patent [19]

Saito et al.

[11] Patent Number: 5,085,530

[45] Date of Patent: Feb. 4, 1992

[54] SINGLE MOTOR MOVING RIBBON AND EXCHANGING CHARACTER HOLDING MEMBER,ALL ON PRINT CARRIER

[75] Inventors: Hideo Saito, Mitsukaido; Tadashi Kimura, Iwai; Hiroatsu Kondo, Zushi, all of Japan

[73] Assignee: Canon Kabushiki Kaisha, Tokyo, Japan

[21] Appl. No.: 449,326

[22] Filed: Dec. 11, 1989

Related U.S. Application Data

[63] Continuation of Ser. No. 73,216, Jul. 14, 1987, abandoned.

[30] Foreign Application Priority Data

Jul. 17, 1986 [JP] Japan ..... 61-168289

[51] Int. Cl.[5] ..... B41J 1/30

[52] U.S. Cl. ..... 400/171; 400/144.2

[58] Field of Search ..... 400/82, 144.2, 149, 400/171, 175, 185, 187, 212, 229, 150.151, 151.1

[56] References Cited

U.S. PATENT DOCUMENTS

| | | | |
|---|---|---|---|
| 4,026,403 | 5/1977 | Inose et al. | 400/151 X |
| 4,281,938 | 8/1981 | Phillips | 400/144.2 X |
| 4,289,412 | 9/1981 | Dollenmayer | 400/171 |
| 4,330,218 | 5/1982 | Habich et al. | 400/144.2 |
| 4,357,115 | 11/1982 | Or | 400/144.2 X |
| 4,406,552 | 9/1983 | Cherrendiner et al. | 400/171 X |
| 4,494,884 | 1/1985 | Lowell | 400/82 X |
| 4,509,872 | 4/1985 | Shimogawara | 400/185 |

FOREIGN PATENT DOCUMENTS

| | | | |
|---|---|---|---|
| 2919209 | 11/1980 | Fed. Rep. of Germany | 400/144.2 |
| 218039 | 1/1985 | German Democratic Rep. | 400/144.2 |
| 0036454 | 3/1983 | Japan | 400/171 |
| 39464 | 3/1983 | Japan | 400/171 |
| 126183 | 7/1983 | Japan | 400/212 |

OTHER PUBLICATIONS

IBM Technical Disclosure Bulletin, vol. 18, No. 10, Mar. 1976, "Semiautomatic Print Wheel Loader", Cox and Smith, p. 3356.

IBM Technical Disclosure Bulletin, vol. 18, No. 10, Mar. 1976, "Automatic Print Wheel Loader", Bleau, pp. 3350–3351.

IBM Technical Disclosure Bulletin, vol. 22, No. 10, Mar. 1980, "Multiple Print Wheel Font Changing Apparatus", Hunt, pp. 4349–4350.

R. F. Springer, "Printwheel Removal & Ribbon Cartridge Lifting Mechanism", *IBM Technical Disclosure Bulletin*, vol. 23, No. 4, p. 1516, Sep. 1980.

*Primary Examiner*—David A. Wiecking

*Attorney, Agent, or Firm*—Fitzpatrick, Cella, Harper & Scinto

[57] ABSTRACT

A printer of the automatically interchangeable character wheel type includes a platen formed lengthwise of the printer to support one surface of a printing sheet, and a carriage guided so as to be reciprocally movable along the platen. The carriage carries thereon contain a housing for containing a character wheel therein, a first shift device for shifting the character wheel in the containing housing to a printing position, a printing hammer for impacting the characters of the character wheel in the printing position, and a second shift device for shifting an ink ribbon to a first position for printing and a second position for standby by the same motor that drives the first shaft device.

2 Claims, 4 Drawing Sheets

SINGLE MOTOR MOVING RIBBON AND EXCHANGING CHARACTER HOLDING MEMBER,ALL ON PRINT CARRIER

This application is a continuation of application Ser. No. 073,216 filed July 14, 1987 now abandoned.

BACKGROUND OF THE INVENTION

1. Field of the Invention

This invention relates to a printer of the automatically iterchangeable character wheel type having a plurality of character wheels and effecting printing while automatically interchanging the character wheels as desired.

2. Related Background Art

There have heretofore been printers having a plurality of character members each provided with a plurality of characters and effecting printing while automatically interchanging the character members. They are disclosed, for example, in U. S. Pat. No. 4,357,115, U.S. Pat. No. 4,281,938, U.S. Pat. No. 4,026,403 and Japanese Laid-Open Patent Application No. 39464/1983.

However, from the viewpoint of high-speed printing, these printers could not always be said to be sufficient. So, in order to solve this problem, the applicant has proposed in Japanese Patent Application No. 177754/1985 (U.S. application Ser. No. 896,056 filed Aug. 13, 1986) a printer which carriers a plurality of disc-like character wheels and in which a desired character wheel may be automatically mounted by a wheel interchanging mechanism provided on a carriage.

The present invention may be said to be an improvement in such printer.

SUMMARY OF THE INVENTION

It is an object of the present invention to apply more effective improvements to a printer of the automatically interchangeable character wheel type.

It is another object of the present invention to reduce the number of parts in such printer and thereby make the printer more compact and lighter in weight.

It is still another object of the present invention to enable an interchanging mechanism for mounting or dismounting in a printing position a character wheel carried on a carriage and a mechanism for moving an ink ribbon up and down to be operated by the same drive source, thereby making the carriage lighter in weight.

It is yet, still another object of the present invention to achieve higher speed of printing.

Other objects of the present invention will become apparent from the following detailed description of the invention.

DESCRIPTION OF THE PREFERRED EMBODIMENT

Figure 1:
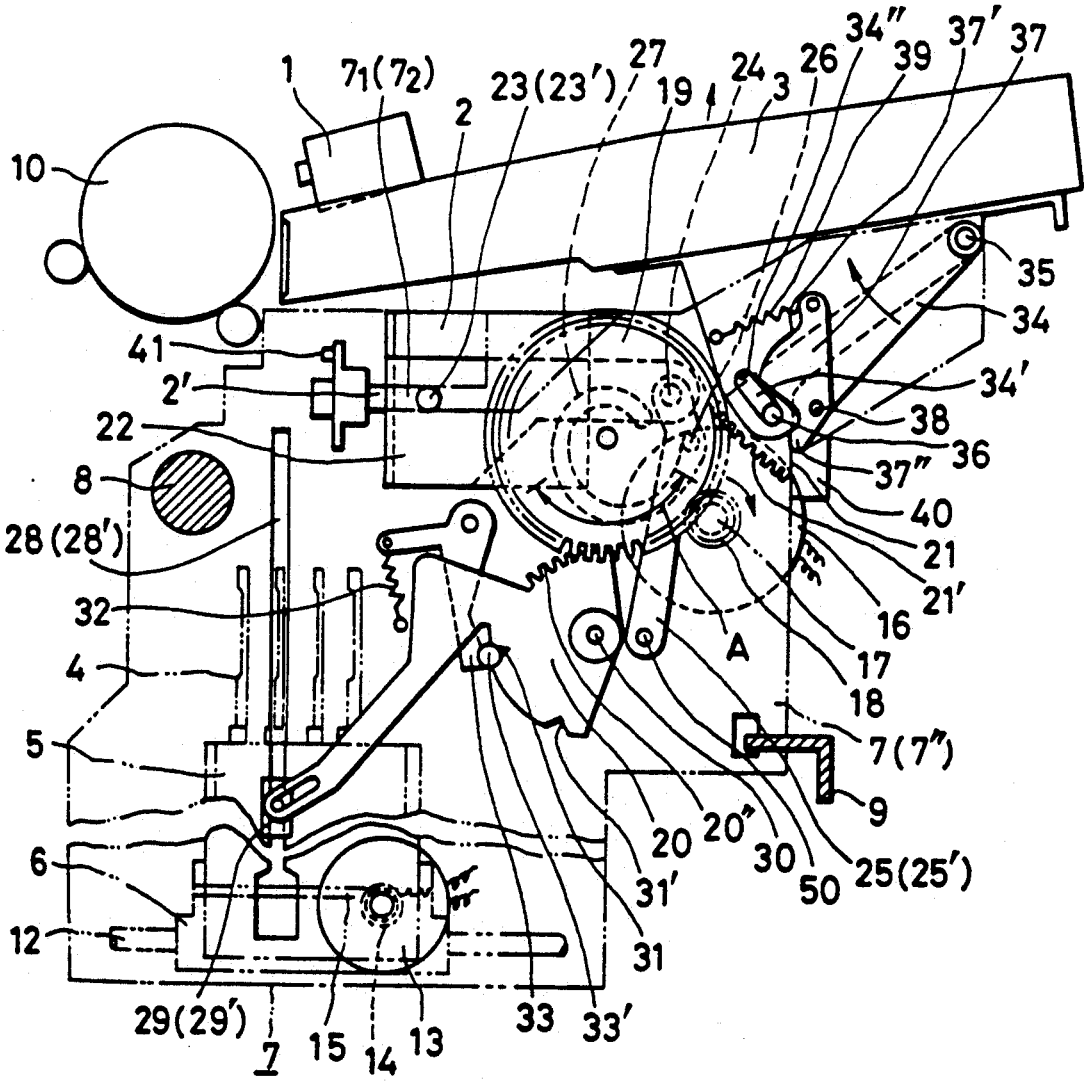
FIG. 1 is a side view of an embodiment of the present invention.
Figure 2:
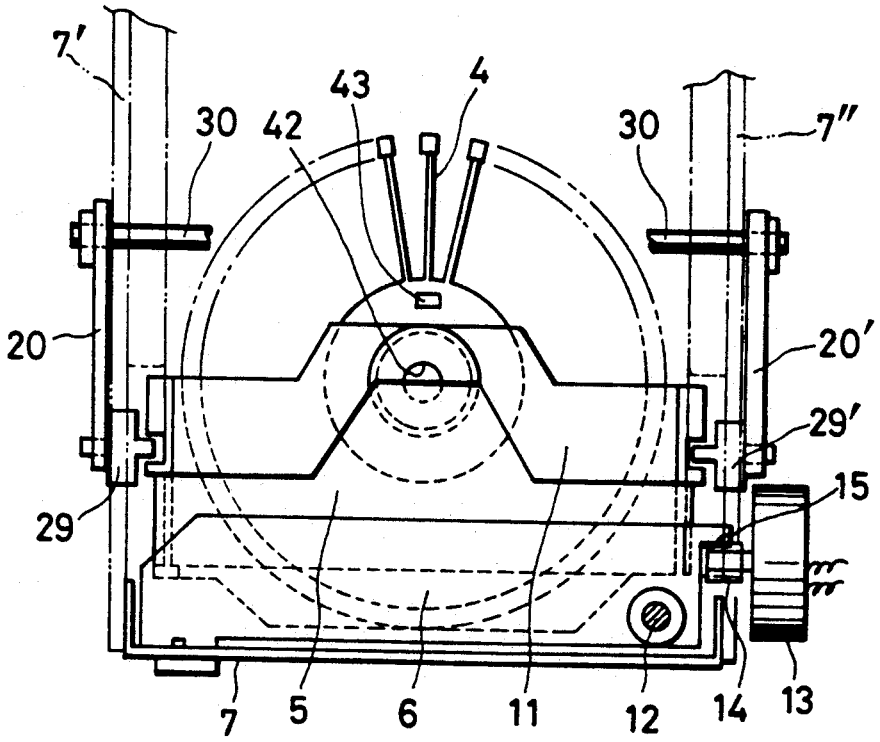
FIG. 2 is a front cross-sectional view of a portion of the embodiment.
Figure 3:
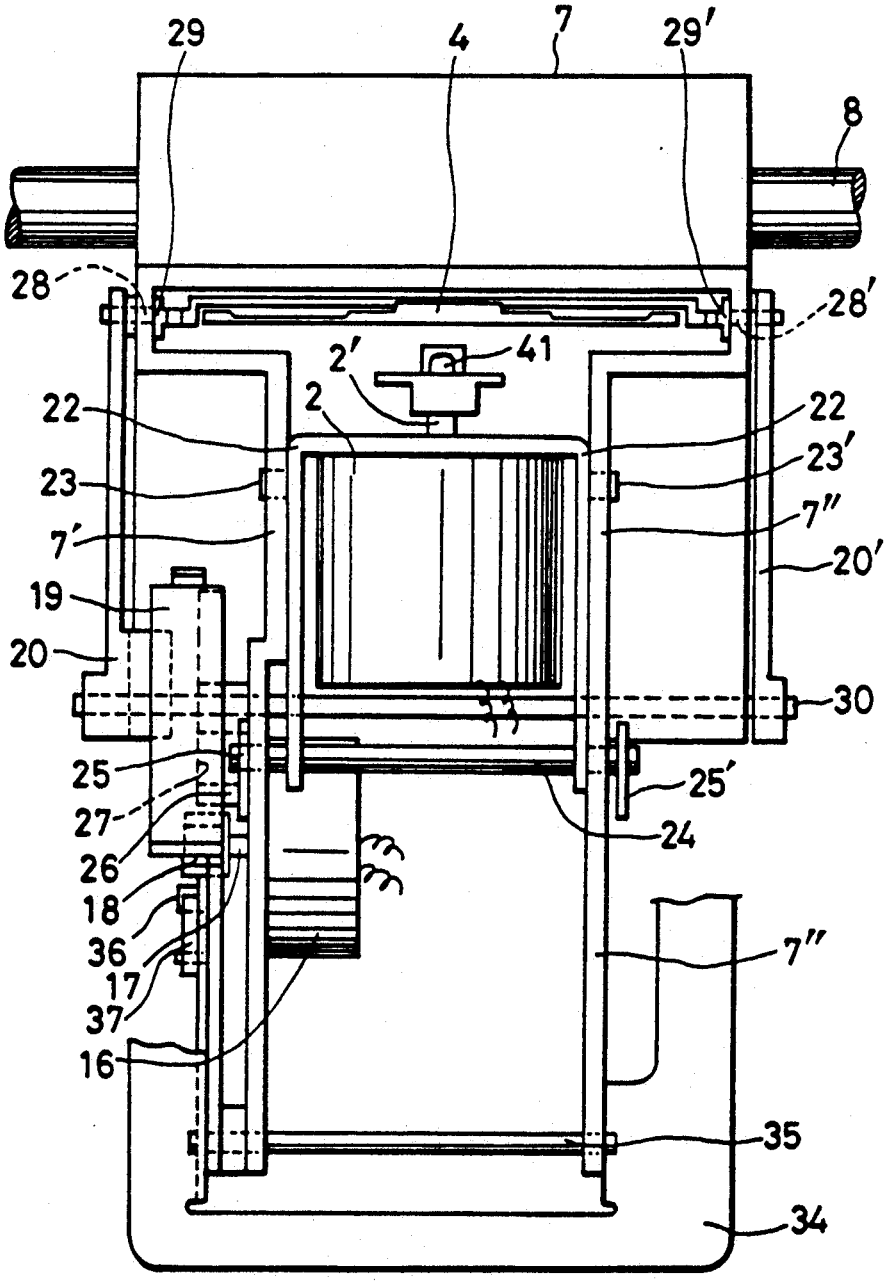
FIG. 3 is a plan view of a portion of the embodiment.

Referring to FIGS. 1 to 5 which show an embodiment of the present invention, reference numeral 1 designates a printing hammer, reference numeral 2 denotes a character selecting motor, reference numeral 3 designates a printing ribbon, reference numeral 4 denotes a character wheel, reference numeral 5 designates a containing housing for the character wheel, and reference numeral 6 denotes a cradle for the containing housing. A carrier 7 provided with a printing unit constituted by these is mounted for movement in parallel with the direction of the axis of a platen 10 rotatably mounted on a machine bed (not shown), on a support rod 8 and a rail 9 provided on the machine bed (not shown). The character wheel 4 is mounted chiefly on a vertically movable member 11 as shown in FIG. 2, and is contained in containing housing 5 for upward movement with a predetermined spacing maintained with respect to the latter, and the cradle 6 and thus, the containing housing 5 is mounted on the carrier 7 for movement to the left and right as viewed in FIG. 1 through a guide rod 12 provided in the carrier 7, a motor 13, a gear 14 and a rack 15 provided in the cradle 6. Referring again to FIG. 1, reference numeral 16 designates a drive motor provided in the upper portion (the rightward portion as viewed in FIG. 1) of one side (the left side as viewed in FIG. 2) of the carrier 7, and a gear 18 provided on the shaft 17 of the drive motor 16 is in meshing engagement with a cam gear 19 mounted for rotation on said one side of the carrier 7. The cam gear 19 is in meshing engagement with a gear portion 20" provided on the upper edge of a shift arm 20 as a driving member for vertically moving the character wheel 4 which will later be described in detail, a gear portion 21' provided on one side edge of a sector plate 21 as a driving member for the printing ribbon 3 which will later be described in detail, and the aforementioned gear 18, and has no tooth except in the range required for these (i.e., the range indicated by A in FIG. 1). Also, the aforementioned character selecting motor 2 is fixed to a support plate 22 as shown in FIG. 3, and pins 23 projectedly provided on the opposite sides of the support plate 22 are fitted in guide holes $7_1$ and $7_2$, respectively, formed in the side plates 7' and 7" of the carrier 7. Further, the support plate 22 is connected to a connecting rod 24 mounted for rotation between the side plates 7' and 7". Pivotable rods 25 and 25' held for pivotal movement relative to the side plates 7' and 7" by shafts 50 and 50' have their free ends connected to the connecting rod 24. A pin 26 is projectedly provided on one end portion of the pivotable rod 25, and this pin 26 is fitted in a slot cam 27 formed in the cam gear 19.

With the above-described construction, when the cam gear 19 is rotated, the pins 23 and 23' of the support plate 22 are guided by the guide slots $7_1$ and $7_2$ and move to the left and right as viewed in FIG. 1.

Reference numerals 28 and 28' designate a pair of straight grooves formed in the opposite side plates $7_1$ and $7_2$ of the carrier 7 to guide a pair of engaging members 29 and 29' vertically moved by the shift arms 20 and 20' and vertically move the character wheel 4 through the engaging members 29 and 29'. Also, the shift arms 20 and 20', as shown in FIG. 2, are connected together by a connecting rod 30 for rotation between the opposite side plates 7' and 7", and a pair of vertical position controlling V-shaped grooves 31 and 31' are formed in one side edge of the substantially central portion of one shift arm 20, as shown in FIG. 1. The pin 33' of a controlling rod 33 pivotably held on the side plate 7' and normally biased in one direction (counterclockwise direction as viewed in FIG. 1) by the force of a spring 32 is engaged with one of the V-shaped grooves 31 and 31'. By this engagement, the shift lever 20 can be temporarily stopped. A printing ribbon frame 34 is mounted for pivotal movement on a support shaft 35 mounted between the opposite side plates 7' and 7''. The other end portion of the sector plate 21 is rotatably mounted on the support shaft 35, and a pin 36 projectedly provided on one side thereof (in a direction perpendicular to the plane of the drawing sheet of FIG. 1) is engaged with a slot 34' formed in the ribbon frame 34. A cam plate 37 is rotatably mounted on a shaft 38 provided on the ribbon frame 34 and is normally biased by the force of a spring 39 provided between the cam plate and the ribbon frame so that the cam surface 37' thereof is engaged with the pin 36 of the sector plate 21. A projection 37'' projected downwardly of the cam plate (toward this side as viewed in FIG. 1) is engaged with a projected portion 40 provided on the side plate 7' of the carrier 7, whereby the cam plate 37 can be pivotally moved against the force of the spring 39. Reference numeral 41 designates a connecting pin provided of the shaft 2' of the selecting motor 2, reference numeral 42 denotes a shaft hole engaged by the shaft 2', and reference numeral 43 designates a connecting hole engaged by the connecting pin 41.

In the above-described construction, a desired character wheel 4 is moved with the cradle 6 by the revolution of the motor 13 while remaining contained in the containing housing 5 and comes into engagement with the engaging members 29 and 29' under a position suitable for printing (accordingly, the position of the straight grooves 28, 28' of the carrier 7), whereafter the drive motor 16 is operated to rotate the cam gear 19 in the direction of arrow indicated in FIG. 1 by the gear 18 on the shaft 17 thereof. Thereby the gear portion of the cam gear 19 and the gear portion 20' of the shift arm 20 come into meshing engagement with each other to thereby release the engagement between the V-shaped groove 31 in the shift arm 20 and the pin 33' of the controlling rod 33. By further revolution of the motor 16, the character wheel 4 is moved up to a position suitable for printing through the engaging members 29 and 29'.

Figure 4:
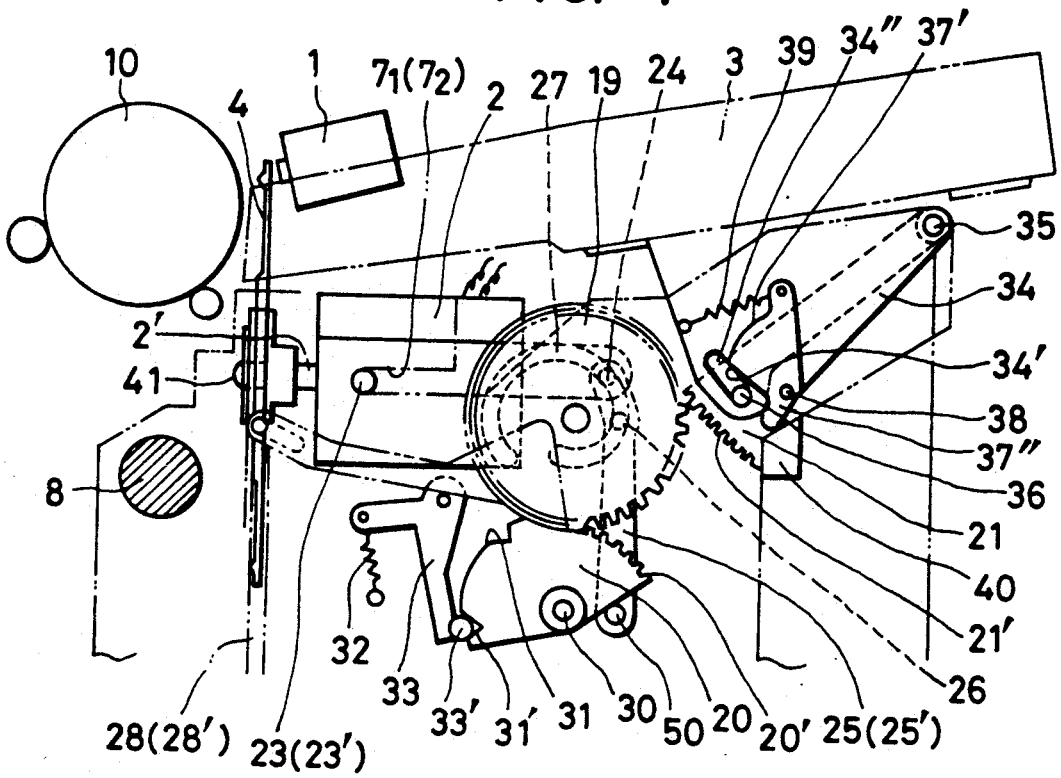
FIGS. 4 and 5 are side views of a portion of the embodiment shown in different operative conditions.
Figure 5:
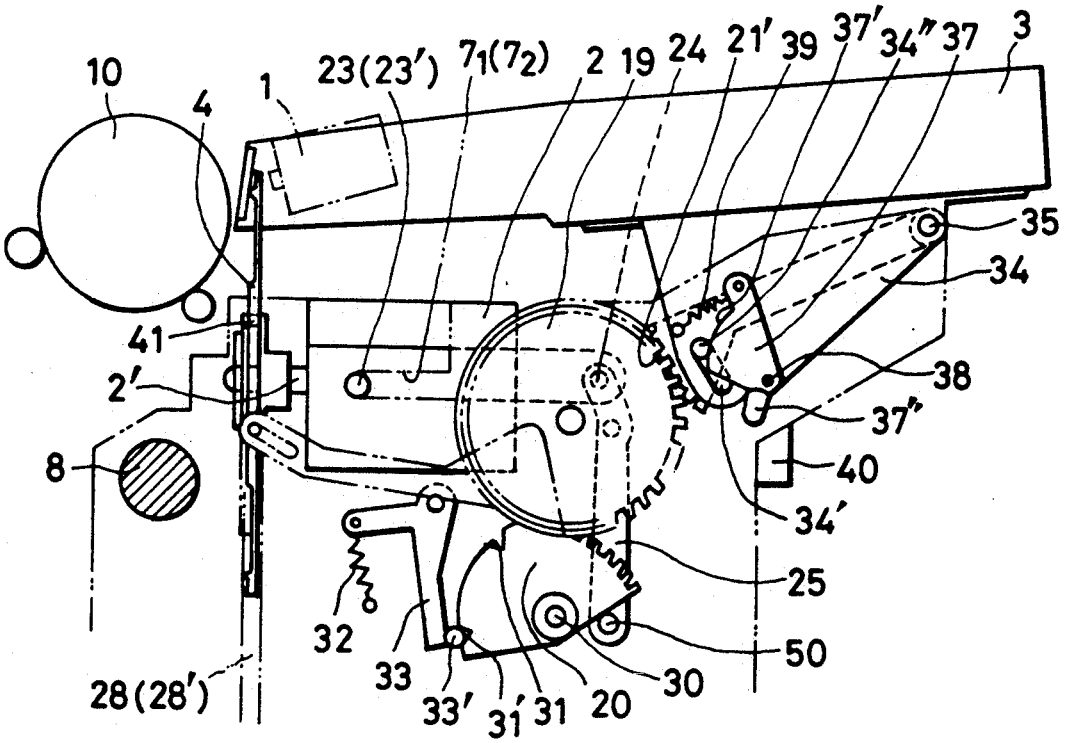

When the character wheel 4 comes to the position suitable for printing, the gear portion 20' arrives at the untoothed portion of the cam gear 19 and stops thereat and at the same time, by the pivotal movement of the controlling rod 33 caused by the force of the spring 32, the pin 33' thereof is brought into engagement with the V-shaped groove 31' in the shift arm 20, thereby temporarily stopping the shift arm 20 (and accordingly, the character wheel 4) at that position. By the subsequent rotation of the cam gear 19 caused by the rotation of the drive motor shaft 17, and by the pivotal movement of the pivotable rods 25, and 25' caused by the engagement between the slot cam 27 of the cam gear 19 and the pin 26 of the pivotable rod 25, the character selecting motor 2 is moved toward the platen 10 with the shaft 2' thereof through the support plate 22. By the movement of this character selecting motor, the shaft 2' thereof and the connecting pin 41 are brought into engagement with the shaft hole 42 and connecting hole 43, respectively, in the character wheel 4 located at the position suitable for printing. Thus, the character wheel 4 and the shaft 2' are connected for rotation as a unit and the setting of the character wheel 4 to the position suitable for printing is terminated. By the subsequent rotation of the cam gear 19 caused by the rotation of the drive motor shaft 17, the gear portion of the gear 19 comes into meshing engagement with the gear portion 21' of the sector plate 21 for the first time, thereby rotating the sector plate 21 in the direction of arrow indicated in FIG. 1. By this rotation, the pin 36 of the sector plate is caused to strike against the upper end portion 34'' of the slot 34' in the ribbon frame 34, whereby the ribbon frame 34 is pivotally moved in the direction of arrow indicated in FIG. 1 with the printing ribbon 3, which thus comes to the position suitable for printing, whereupon the revolution of the drive motor 16 is stopped. In the course of the pivotal movement of the ribbon frame, the projection 37'' of the cam plate 37 mounted on the ribbon frame 34 becomes disengaged from the projection 40 provided on the side plate 7' of the carrier 7, the cam plate 37 is pivotally moved by the biasing force of the spring 39, and the cam surface 37' thereof comes into engagement with the pin 36 on the sector plate 21, thereby making the sector plate 21 and the ribbon frame 34 unitary. Thereby, backward movement of the ribbon frame 34 may be prevented and the printing ribbon 3 may be maintained at the printing position. (FIGS. 4 and 5 show the state in the meantime.) Subsequently, after printing has been terminated, the drive motor 16 is revolved in the direction opposite to that previously described, whereby each portion may be operated in the direction opposite to that previously described and restores the state before the operation.

Where various types of printing ribbons such as black and red printing ribbons and a printing ribbon for modifying the printing are supported on the ribbon frame and the ribbon frame is to be multistage-shifted as required, this can be accomplished by changing the amount of revolution of the drive motor in conformity with the supported positions of the printing ribbons.

Accordingly to the present embodiment, as described above, the driving member for locating a desired character wheel at the position suitable for printing from the containing housing for the character wheel and the driving member for locating the printing ribbon at the position suitable for printing are adapted to be driven by the revolution of a single drive motor provided in the carrier and therefore, the weight, volume, etc. of the carrier are reduced as compared with the prior-art carrier, and this is greatly effective to achieve compactness and improved printing speed of the apparatus.

We claim:

1. A printer for recording on a recording medium, comprising:

a platen;

an ink ribbon mounting section;

displacement means for displacing an ink ribbon mounted on said ink ribbon mounting section between a recording position and a retracted position retracted from said recording position, said displacement means having a first gear arrangement including a primary gear for driving said displacement means between the recording position and the retracted position;

a carrier reciprocally moveable along said platen, said carrier having a containing section for a character holding member for holding characters;

a character holding member mounting section;

a hammer for pressing the characters of said character holding member to said recording medium through the ink ribbon mounted on said ink ribbon mounting section;

mounting means for detachably mounting said character holding member contained in said containing section on said character holding member mounting section, said mounting means having a second gear arrangement including said primary gear for driving said mounting means to mount said character holding member; and a driving motor for driving said primary gear to actuate said first gear arrangement to displace said ink ribbon mounted on said ink ribbon mounting section and to actuate said second gear arrangement to mount said character holding member contained in said character holding member on said character holding member mounting section.

2. A printer for recording on a recording medium, comprising:

an ink ribbon mounting section;

displacement means for displacing an ink ribbon mounted on said ink ribbon mounting section between a recording position and a retracted position retracted from said recording position, said displacement means having a first gear arrangement including a primary gear for driving said displacement means between the recording position and the retracted position;

a containing section for a character holding member having characters; a carrier reciprocally moveable along a print line, said carrier having said containing section mounted thereon;

a character holding member mounting section for detachably mounting said character holding member;

mounting means for moving said character holding member selected from said containing section to mount said selected character holding member on said character holding member mounting section, said mounting means having a second gear arrangement including said primary gear for driving the mounting means to mount said character holding member;

a driving motor for driving said primary gear to actuate said first gear arrangement to displace said ink ribbon mounted on said ink ribbon mounting section and to actuate said second gear arrangement to drive said mounting means independently from said displacement means to mount said character holding member contained in said character holding member on said character holding member mounting section; and a hammer for pressing said characters of said character holding member mounted on said character holding member to said recording medium through said ink ribbon mounted on said ink ribbon mounting section.

* * * * *

UNITED STATES PATENT AND TRADEMARK OFFICE

CERTIFICATE OF CORRECTION

PATENT NO. : 5,085,530

DATED : February 4, 1992

INVENTOR(S) : Hideo Saito, et al.

It is certified that error appears in the above-identified patent and that said Letters Patent is hereby corrected as shown below:

On the title page:

[54] TITLE:

"MEMBER,ALL" should read --MEMBER, ALL--.

[56] REFERENCES CITED:

UNITED STATES PATENT DOCUMENTS, "Insert: --4,307,968 Habich, et al. .....400/171--.
"Cherrendiner et al." should read --Chervendinev et al.--.

[57] ABSTRACT:

Line 5, "contain" should be deleted.
Line 13, "shaft" should read --shift--.

COLUMN 1:

Line 4, "MEMBER,ALL" should read --MEMBER, ALL--.
Line 12, "inerchangeable" should read --interchangeable--.
Line 29, "carriers" should read --carries--.

COLUMN 3:

Line 21, "provided of" should provided --provided on--.

COLUMN 4:

Line 36, "Accordingly" should read --According--.

UNITED STATES PATENT AND TRADEMARK OFFICE

CERTIFICATE OF CORRECTION

PATENT NO. : 5,085,530

DATED : February 4, 1992

INVENTOR(S) : Hideo Saito, et al.

It is certified that error appears in the above-identified patent and that said Letters Patent is hereby corrected as shown below:

Column 5, line 28, "characters; a" should read --characters; ¶ a--.

Signed and Sealed this

Thirtieth Day of November, 1993

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,085,530

DATED : February 4, 1992

INVENTOR(S) : Saito, et al.

It is certified that error appears in the above-indentified patent and that said Letters Patent is hereby corrected as shown below:

On the title page:

[54] TITLE:

"MEMBER,ALL" should read --MEMBER, ALL--.

[56] REFERENCES CITED:

UNITED STATES PATENT DOCUMENTS, "Insert: --4,307,968 Habich, et al. .....400/171--.
"Cherrendiner et al." should read --Chervendinev et al.--.

[56] ABSTRACT:

Line 5, "contain" should be deleted.
Line 13, "shaft" should read --shift--.

COLUMN 1:

Line 4, "MEMBER,ALL" should read --MEMBER, ALL--.
Line 12, "inerchangeable" should read --interchangeable--.
Line 29, "carriers" should read --carries--.

COLUMN 3:

Line 21, "provided of" should read --provided on--.

UNITED STATES PATENT AND TRADEMARK OFFICE

CERTIFICATE OF CORRECTION

PATENT NO. : 5,085,530 Page 2 of 2

DATED : February 4, 1992

INVENTOR(S) : Saito, et al.

It is certified that error appears in the above-indentified patent and that said Letters Patent is hereby corrected as shown below:

COLUMN 4:

Line 36, "Accordingly" should read --According--.

COLUMN 5:

Line 13, "said character holding member" should read --said containing section--.
Line 28, "characters; a" should read --characters; ¶ a--.

COLUMN 6:

Lines 20 and 21, "said character holding member" should read --said containing section--.

Signed and Sealed this

Eleventh Day of January, 1994

Bruce Lehman

*Attest:*

BRUCE LEHMAN

*Attesting Officer*

*Commissioner of Patents and Trademarks*